US005345665A

United States Patent [19]

Nemedi

[11] Patent Number: 5,345,665

[45] Date of Patent: Sep. 13, 1994

[54] REPLACEABLE WRAP FOR SCROLL HOUSING IN CENTRIFUGAL SEPARATOR

[75] Inventor: William D. Nemedi, Vicksburg, Mich.

[73] Assignee: Inter-Source Recovery Systems, Inc., Kalamazoo, Mich.

[21] Appl. No.: 88,225

[22] Filed: Jul. 6, 1993

Related U.S. Application Data

[62] Division of Ser. No. 831,168, Feb. 5, 1992, Pat. No. 5,252,208.

[51] Int. Cl.[5] ..... B04B 1/04

[52] U.S. Cl. ..... 29/402.15; 29/402.09; 29/402.14; 210/373; 210/380.1; 210/512.1; 494/43

[58] Field of Search ..... 210/369, 372, 373, 377, 210/512.1, 781, 782; 494/43, 58, 59, 67, 74; 29/402.04, 402.14, 402.15

[56] References Cited

U.S. PATENT DOCUMENTS

| | | | |
|---|---|---|---|
| 4,137,176 | 1/1979 | Dudley et al. | 210/375 |
| 4,186,096 | 1/1980 | Areaux et al. | 210/377 |
| 4,186,097 | 1/1980 | Dudley et al. | 210/377 |
| 4,253,960 | 3/1981 | Dudley et al. | 210/373 |
| 4,298,476 | 11/1981 | Dudley | 210/373 |
| 4,936,822 | 6/1990 | Nemedi | 494/43 |

*Primary Examiner*—Robert A. Dawson
*Assistant Examiner*—David Reifsnyder
*Attorney, Agent, or Firm*—Marshall, O'Toole, Gerstein, Murray & Borun

[57] ABSTRACT

A liner or wrap for use in the scroll or discharge housing of a centrifugal separator device. The wrap comprises a one-piece, elongated strip of material which is releasably secured to the interior wall which is replaceable in the event of excessive wear. The wrap is compressible and can be placed into the separator device without having to remove the blade assemblies. The releasable wrap is seated against the discharge housing wall contiguous to blades which are rotatable in the discharge housing.

5 Claims, 2 Drawing Sheets

REPLACEABLE WRAP FOR SCROLL HOUSING IN CENTRIFUGAL SEPARATOR

This is a division of U.S. application Ser. No. 831,168, filed Feb. 5, 1992, now U.S. Pat. No. 5,252,208.

FIELD OF INVENTION

This invention relates generally to a centrifugal separator for separating lubricating and other fluids from metal or other scrap materials and more particularly to a compressible wrap to be placed in the scroll of the discharge housing of the separator.

RELATED APPLICATION

This application is related to application S.N. 08/112,597, still pending filed this day by William D. Nemedi entitled "Segmented Centrifugal Separator Scroll Housing."

BACKGROUND OF THE INVENTION

Centrifuge systems for continuously feeding and removing liquid from metal chips, shavings or other material impregnated with lubricating or other fluids are known in the prior art. As used herein, these materials are referred to as "chips." Such systems are illustrated, for example, in Nemedi U.S. Pat. No. 4,936,822, Dudley U.S. Pat. No. 4,137,176 and Areaux U.S. Pat. No. 4,186,096. In these systems, the centrifugal separator unit includes a plurality of blades attached to the bottom wall of a rotatable separator bowl disposed inside the centrifugal parts separator unit. The bowl and blades rotate about a vertical axis during operation causing the mixture of the chips and lubricant to move upward along the interior side of the bowl. The centrifuged mixture moves past a screen at the upper edge of the bowl at which location lubricant is separated out from the chips. The rotating blades or other suitable means in the centrifugal separator serve to generate air movement sufficient to blow or pull the chips or other materials through and out of an annular-shaped discharge housing, referred to as a scroll, to a further location where the separated materials are collected.

When the separated chips reach the discharge housing following lubricant removal, they are relatively dry, most of the lubricant having been removed. In some instances, the chips are believed to be moving at speeds upwards in excess of 100 miles per hour. Due to the high speeds and the dryness of the chips, excessive wear occurs throughout at least the annular-shaped portion of the discharge housing.

As described in Nemedi '822 patent, depending upon the use of the separator device, a problem sometimes arises due to the wear of the separator parts. In the annular-shaped portion of the discharge housing located above the lubricant discharge area, the chips scrape the sides of the housing as the chips and materials move toward the exit discharge opening. Scraping of the sides causes adverse wear in at least the annular-shaped portion of the discharge housing. With prior art centrifugal separating devices, it generally is necessary to dismantle a substantial portion of the machine to remove and replace a worn discharge housing or its components. Replacement is often times a relatively expensive, time consuming procedure because of the down time of the machine, the cost of the replacement parts, and the labor of mechanics required to perform the replacement operation.

In some instances a metal liner has been placed against the annular-shaped portion of the wall and permanently welded in place. This use of a permanent liner has not been entirely satisfactory because the liner will wear after a period of time, and being permanently fixed to the wall, the worn or damaged discharge housing and permanently mounted liner must be replaced.

What is desired is to have a centrifugal separator device wherein the worn or damaged portion of the discharge housing can be relatively easily repaired without the need for disassembling a substantial portion of the separator device. Accordingly, it is a general object of the present invention to provide a centrifugal separator apparatus having an improved discharge housing wherein at least the scroll portion of the discharge housing can be relatively readily repaired.

SUMMARY OF THE INVENTION

The invention disclosed and claimed herein serves to obviate the problems associated with conventional centrifugal separator devices and to achieve the desires sought in repairing worn portions of the discharge housing. Briefly, the present invention relates to a centrifugal separator apparatus of the type which comprises: a rotatable cone-shaped centrifugal separator bowl, a plurality of angularly spaced blades attached to the interior side of the bowl, an annular screen located at the upper edge of the bowl through which lubricant to be separated may flow, and, a discharge housing disposed above the screen and which surrounds the upper ends of the rotatable blades. The discharge housing often referred to as a scroll housing is annular-shaped. The housing includes a straight discharge section having an exit opening for the discharge of chips from the separator device following chip lubricant separation.

In accordance with the invention disclosed and claimed herein, the interior surface of the discharge or scroll housing is lined with a replaceable wrap of material which forms a scroll liner. The wrap is formed of a material which can be compressed and wound into a reduced diameter of material so that it can be inserted into the centrifuge separator. Upon insertion, the wrap is permitted to expand outwardly where it seats against the wall of the scroll in the discharge housing. The wrap is releasably fastened to at least the annular-shaped portion of the discharge housing of the separator device. The wrap is removable and can be replaced, as needed, with another wrap. Further, the wrap can be installed into the discharge portion of the housing without having to disassemble or otherwise remove the blades located in the separator bowl. As a result, repair of worn or damaged sections of the annular-shaped portion of the discharge housing can be accomplished relatively efficiently.

DESCRIPTION OF THE DRAWINGS

Further advantages of the invention will become apparent upon a reading of the following detailed description taken in conjunction with the accompanying drawings in which.

DETAILED DESCRIPTION

Figure 1:
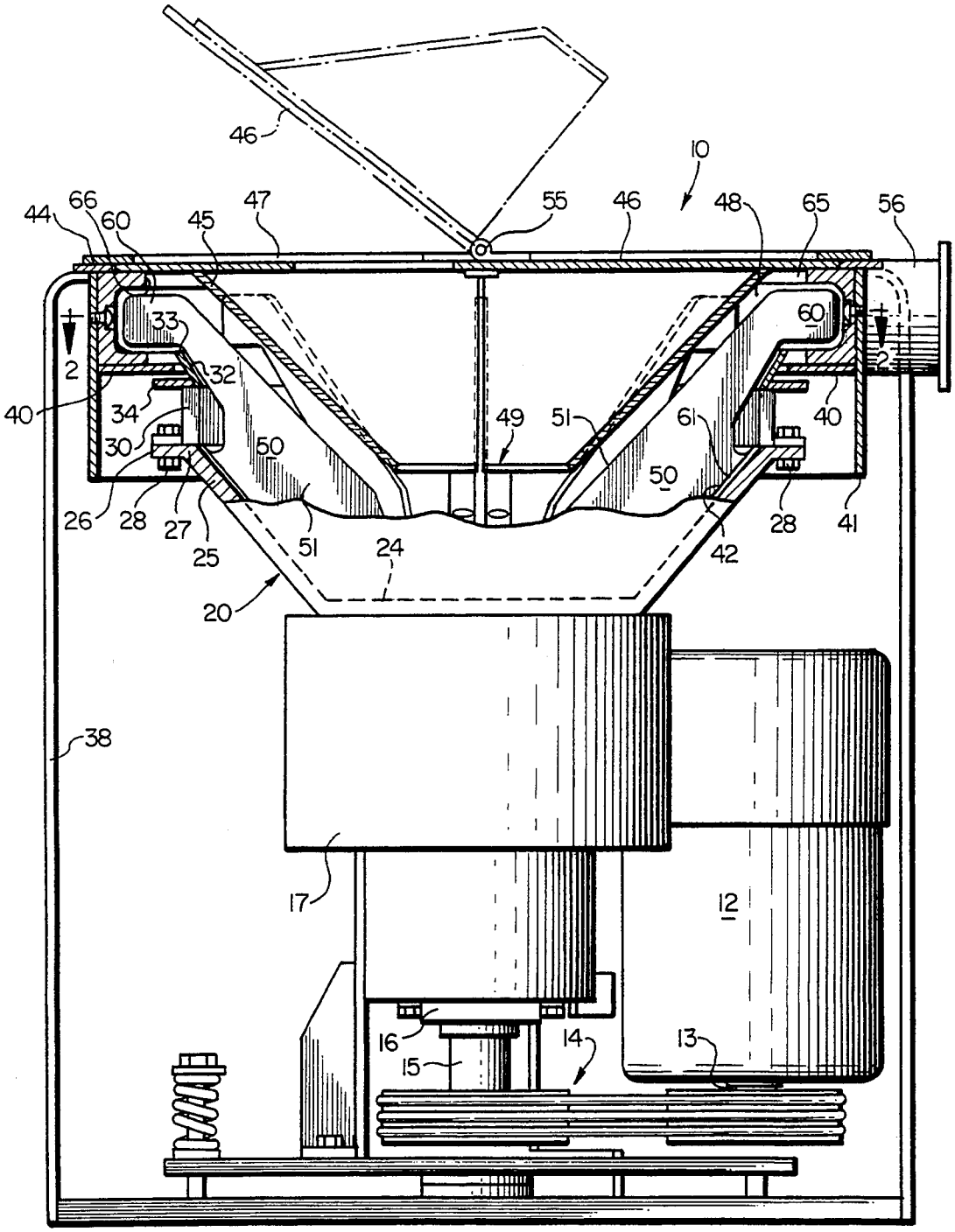
FIG. 1 shows a front, partial section view of a centrifugal separator apparatus including the discharge housing having a replaceable wrap releasably positioned against the annular-shaped wall of the discharge housing.

Referring to the drawings and particularly to FIG. 1, there is shown centrifugal separator device 10 which includes motor 12 which has a drive shaft 13 connected by belt and pulley drive assembly 14 to one end of centrifugal separator drive shaft 15. Shaft 15 is disposed within bearing assembly 16.

The remaining end of drive shaft 15 is secured to a substantially cone or bell-shaped separator bowl 20. Upon actuation of motor 12, bowl 20 connected to shaft 15 rotates. Cylindrical housing 17 encloses the lower end of the bowl 20 and shaft 15.

Bottom wall 24 of separator bowl 20, which has inner and outer wall surfaces, extends outwardly and terminates in bowl wall 25. Wall 25 extends vertically upwardly and outwardly with a mounting flange 26 located at upper end 27 of bowl wall 25. A substantially cylindrical separator screen 30, which is defined by a wire mesh or a plurality of spaced, elongated bars forming narrow openings, or the like, extends upwardly from flange 26. Screen 30 permits discharge of lubricating liquid separated from the metal chips in the centrifuged separator bowl, the lubricant passing through the mesh or other openings in screen 30 while the metal chips are centrifuged upwardly past screen. Liquid discharged through the openings in screen 30 will be collected in a suitable collection chamber, not shown, preferably disposed within casing chamber 38 in which the parts of the centrifugal separator device are disposed. Screen 30 is secured to flange 26 by means of a plurality of suitable fasteners 28.

Conical portion 32 is secured to the upper edge of screen 30 and extends radially outward in an upward direction to dispensing edge 33. A radially extending flange 34 is secured to the centrifugal separator bowl 20 intermediate the juncture between conical portion 32 and screen 30. A radially inwardly directed flange 40 is secured to cylindrical outer wall support member 41 which depends from and is attached to the top of chamber 38 as seen in FIG. 1.

Cover 44 is fixed in any desired manner to the upper edge of chamber 38, the cover having a circular opening 62. In the particular embodiment of FIG. 1, cover 44 includes an upper conical member 45 which is fixedly attached to and depends from cover 44, member 45 serving to cover opening 62. Conical member 45 comprises two pivotable cone-shaped portions 46, 47 whereby the outer wall of conical member 45 defines the inner wall of annular chip collecting chamber 48 and the cylindrical support wall member 42 defines the outer wall thereof.

Cone 45 converges in a downward direction to a location spaced immediately above and within separator bowl 20. Opening 49 at the bowl lower end of conical member 45 defines an air inlet as well as a material inlet for a mix of lubricant plus chips, shavings or the like into centrifuge separator device 10. Spaced blade assemblies 50 are securely fastened to and rotate with rotatable separator bowl 20.

In a typical operation, metal chips and lubricating fluids to be separated are delivered to the top of centrifuge 10 from a discharge end of a separator chute, not shown, which is well known in the prior art. The mixed chips and fluids enter centrifuge 10 and pass through opening 49 at the bottom of conical member 45. The fluid mixed with the metal chips passes into rotating separator bowl 20 where the materials to be separated are centrifuged outwardly and travel upwardly along both the internal surface of bowl wall 25 and the leading surfaces of the rotating blades in blade assemblies 50. The lubricating fluid separates from the chips and passes through screen 30 to a collection chamber (not shown) where the lubricating fluid is collected. The rotating blades also serve to draw or pull fluid such as air downwardly through opening 49 in cone 45. The air then passes upwardly through the space between the outside surface of cone 45 and bowl 20. Following separation from the lubricating fluid, metal chips, shavings and the like, continue to be directed upward by the centrifugal action of the separating device past screen 30 and dispensing edge 33 where the separated chips and shavings are directed out of discharge chamber 48 and exit chute 56 to a collecting site.

Separator bowl 20 is shown with eight spaced blade assemblies 50 disposed within, the blades preferably being releasably fixed to the bowl. As disclosed in Nemedi U.S. Pat. No. 4,936,822, the disclosure of which is incorporated herein by reference, each blade assembly 50 includes a pad 61 (FIG. 1), which is secured to the bowl 20 and extends at right angles to blade 51. Blade 51 projects upward beyond the location of screen 30 into chamber 48 of discharge housing 65 as shown in FIG. 1. Each blade 51 includes a radially extending paddle 60 at its upper end, which is disposed within the scroll housing described hereafter.

Figure 2:
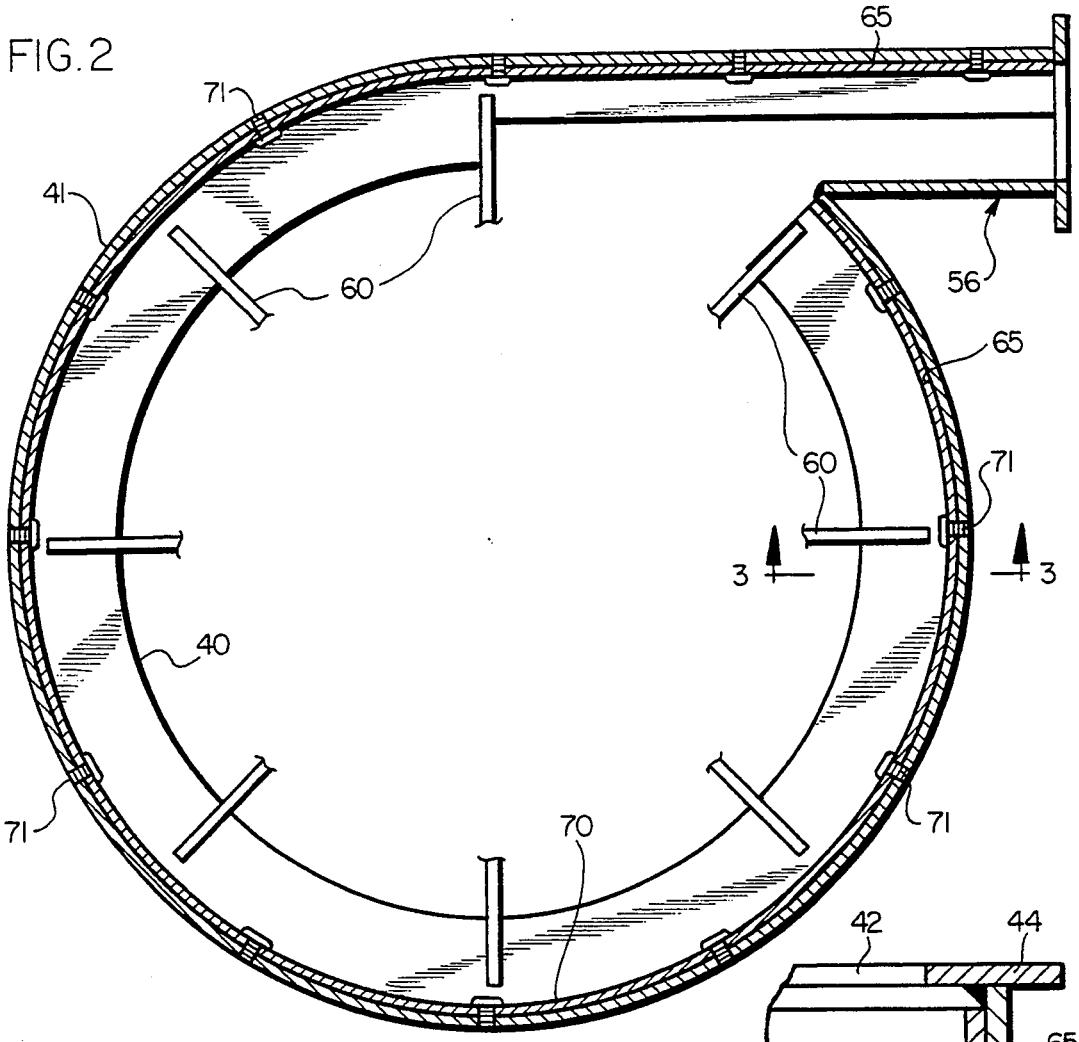
FIG. 2 shows a top section view taken along lines 2—2 in FIG. 1.
Figure 3:
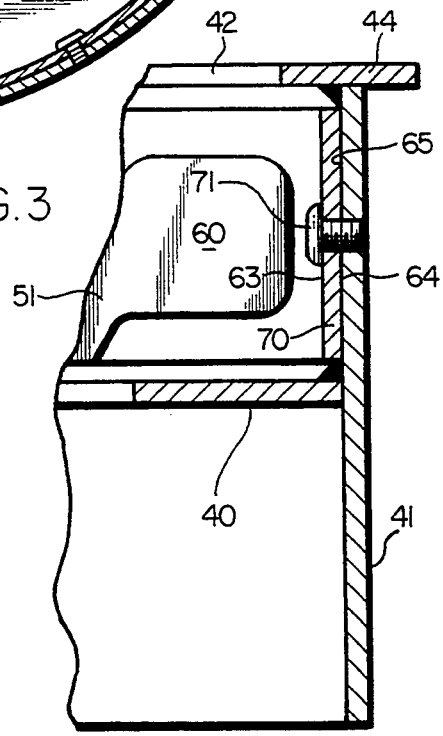
FIG. 3 shows an enlarged, partial fragmentary section view taken along lines 3—3 in FIG. 2 and illustrates a top portion of a blade and the scroll housing of FIG. 1; and, FIG. 4 shows a perspective view of the wrap in a compressed condition prior to inserting the wrap into the separator device.

The air movement within the scroll or discharge chamber 48 plus blade paddles 60 serve to direct or otherwise move the chips through the annular-shaped portion of discharge chamber 48 and exit chute 56. As best shown in FIGS. 1 and 2, discharge chamber 48 comprises an annular-shaped scroll formed by support wall 40, a portion of wall 41 and cover wall 44. As each blade 51 and its respective blade paddle 60 rotates in a clockwise direction, air and metal chips are swept, blown or pulled past the wall of the scroll and out the discharge outlet 56.

It has been found that considerable wear occurs in the annular-shaped portion of the discharge chamber 48. The metal chips, which are relatively free of lubricant, scrape along the sides of the wall at at least the annular-shaped portion of the discharge chamber as they move to the straight chip discharge chute 56. In prior art constructions, when extensive wear occurred in this portion of the housing, it generally necessitated the dismantling of blade assemblies 50 and removing cone cover portions 46, 47, which are hinged to the device 10 at 55, and other machine parts in order to remove and replace the damaged discharge housing.

In some instances, a single piece, thin, elongated liner wrap was installed and permanently welded to the inside wall of the annular-shaped portion of the discharge housing. In time, this permanent wrap also becomes worn and both the scroll and permanent liner have to be replaced. This system also has been found to be not entirely satisfactory.

Figure 4:
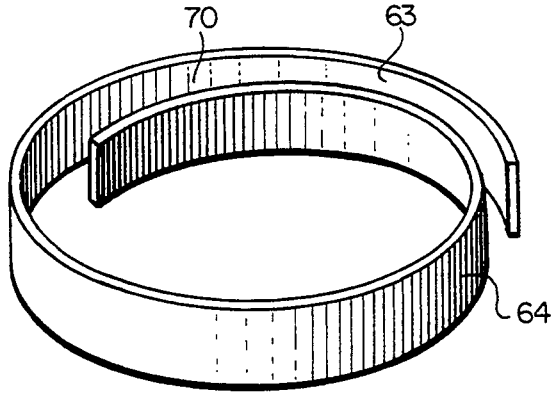

To repair a scroll utilizing the present invention, wrap 70 is employed in which the wrap is a relatively thin, single, elongated strip of material. Wrap 70 having sides 63, 64, is formed in a shape which will permit it to be wound or compressed as seen in FIG. 4 to a diameter which will permit it to be installed in separator 10 through opening 62 in cover 44 located at the top of separator device 10. To install wrap 70, cover 44, i.e., cover portions 46, 47, is removed to allow sufficient access to the separator. Wrap 70 is wound as seen in FIG. 4 to a diameter that is less than the diameter of the cover opening 62. Following insertion of wound wrap 70 into device 10, the wrap is guided over the outboard edges of blade paddles 60 following which, the wrap can expand and seat against the inner surface 65 of cylindrical wall member 41. Once seated in position, bolts 71 serve to releasably attach wrap 70 in position whereby the wrap serves as a liner for at least the annular-shaped portion of the discharge chamber 48. It is appreciated that other means could be utilized to releasably fasten wrap 70 in position.

FIG. 2 shows wrap 70 extending along the inner wall surface 65 of the scroll formed by walls 40, 41 and 44 as well as the internal surface of discharge chute 56. The need to provide a wear liner to the internal wall surface of discharge chute 56 will depend generally upon whether excessive wear has occurred on such surface.

Preferably, for separator devices presently available, it is preferred that wrap 70 be approximately 3.50 inches in height and about 0.25 inches thick. Further, the wrap or replaceable scroll liner 70 preferably is made of a steel alloy containing 11–14% manganese. If desired, the material could be formed of stainless steel. What is important is that between the material selected for the wrap and the thickness of the wrap, the wrap should be formed to be sufficiently compressible as to allow it to be wound or rolled in a spring-like manner as seen in FIG. 4 whereby it can be placed within cover opening 62 on top of device 10. Subsequently, the wrap will be guided over the outer edges of blade paddles 60 whereupon it will expand into position and seat against the inner wall surface 65 of the scroll.

Similarly, bolts 71 preferably are made of a wear-resistant alloy such as stainless steel 400 series. It is appreciated that the bolts are shown as being threaded into a tapped hole in wall 41. If desired, fasteners could be utilized which are passed through aligned openings in wrap 70 and wall 41 following which fastener nuts would be attached to the bolts.

While the invention has been shown and described with a blade assembly installation shown in the Nemedi '822 patent, it is appreciated that other blade arrangements could be utilized as shown, for example, in the Dudley 4,137,176, 4,253,960 and 4,298,476 patents.

It will be apparent from the foregoing that a novel and improved means for repairing the scroll of a separator device has been provided for a centrifugal parts separator or wringer. The wrap of the present invention may be relatively easily installed, removed, replaced or turned over so that the opposite side of the wrap 70 can serve as a wear area. Substantial dismantling of the machine to effect the installation of the wrap is not required. Only cover 44 of separator device 10 need be removed in order that opening 62 be available for insertion of the wrap into the machine.

While one or more embodiments of the invention have been herein illustrated and described in detail, it will be understood that modifications and variations thereof may be effected without departing from the spirit of the invention and the scope of the appended claims.

What is claimed is:

1. The method of repairing a worn wall surface in the discharge housing of a centrifugal separator device comprising: a separator bowl having a plurality of spaced blade assemblies disposed therein;

a discharge housing disposed above said bowl and adapted to receive chips exiting from said bowl; said chips adapted to travel through said discharge housing;

said spaced blade assemblies including a blade having at least a portion thereof which is adapted to rotate in said discharge housing;

means for rotating said blade assemblies whereby said blade portions rotate in said discharge housing to cause chips in said housing to travel through said discharge housing;

said discharge housing comprising a wall and having at least one exit opening therein through which chips exit; and, said method comprising the steps of:

(a) compressing an elongated wrap having two sides and inserting the compressed wrap through an opening in the separator;

(b) passing said wrap over the outer edges of said blade portions located in said discharge housing;

(c) permitting said wrap to seat against said discharge housing wall contiguous to said blade portions; and, (d) releasably securing said wrap to said wall to expose one side of said wrap to discharge materials adapted to pass through said discharge housing.

2. The method of claim 1 and further including the steps of releasing the wrap from said discharge housing wall;

removing said wrap from said discharge chamber;

placing the wrap so that the opposite side of the wrap, when installed in said separator, will be exposed to discharge materials; and, repeating the steps (a)–(d) inclusive whereby said remaining side of said wrap is exposed to materials adapted to pass through said discharge chamber.

3. The method repairing a worn wall surface in the discharge housing of a centrifugal separator device comprising a rotatable bowl;

a discharge housing located above said bowl which receives chips adapted to travel through said discharge housing;

a plurality of spaced blade assemblies disposed in said bowl, each of which includes a blade having at least a portion thereof located in said discharge housing;

means for rotating said blade assemblies whereby said blade portions rotate in said discharge housing to cause chips in said housing to travel through said discharge housing;

said discharge housing comprising a wall and having at least one exit opening therein through which chips exit; and said method comprising the steps of:

(a) compressing an elongated wrap;

(b) inserting the compressed wrap into said discharge housing of said separator;

(c) positioning the wrap against said wall of the separator at least in the area of said worn wall surface; and (d) releasably securing the wrap to the discharge housing wall upon which the wrap is positioned.

4. The method of claims 1 or 3 wherein said wrap has two sides, and further including the steps of removing said wrap from said separator after one side of said wrap becomes worn from contact with chips passing through the discharge chamber; and, reinserting said wrap in a releasable position against said wall in said discharge housing whereby said second wrap surface is exposed to chips passing through said discharge housing.

5. The method of claims 1 or 3 wherein said discharge housing wall is annular-shaped and said wrap is releasably secured to said annular-shaped wall.

* * * * *